US010099339B2

(12) United States Patent
Wu et al.

(10) Patent No.: US 10,099,339 B2
(45) Date of Patent: Oct. 16, 2018

(54) CHEMICAL MECHANICAL POLISHING (CMP) APPARATUS AND METHOD

(71) Applicant: Semiconductor Manufacturing International (Shanghai) Corporation, Shanghai (CN)

(72) Inventors: Ken Wu, Shanghai (CN); Yuntao Jiang, Shanghai (CN); Jun Yang, Shanghai (CN)

(73) Assignee: SEMICONDUCTOR MANUFACTURING INTERNATIONAL (SHANGHAI) CORPORATION, Shanghai (CN)

( * ) Notice: Subject to any disclaimer, the term of this patent is extended or adjusted under 35 U.S.C. 154(b) by 183 days.

(21) Appl. No.: 15/171,672

(22) Filed: Jun. 2, 2016

(65) Prior Publication Data

US 2017/0348819 A1 Dec. 7, 2017

(51) Int. Cl.
*B24B 37/005* (2012.01)
*B24B 37/20* (2012.01)

(52) U.S. Cl.
CPC ..... *B24B 37/005* (2013.01); *B24B 37/20* (2013.01)

(58) Field of Classification Search
CPC ..... B24B 37/005; B24B 37/20
See application file for complete search history.

(56) References Cited

U.S. PATENT DOCUMENTS 5,558,568 A * 9/1996 Talieh ..... B24B 21/06 451/303
5,762,536 A * 6/1998 Pant ..... B24B 21/04 451/296
5,961,372 A * 10/1999 Shendon ..... B24B 21/10 451/299
6,108,091 A * 8/2000 Pecen ..... B24B 37/205 356/369
6,132,289 A * 10/2000 Labunsky ..... B24B 37/345 451/288
6,358,118 B1 * 3/2002 Boehm ..... B24B 1/005 451/24

(Continued)

FOREIGN PATENT DOCUMENTS

CN 1661780 A 8/2005
CN 1962191 A 5/2007

*Primary Examiner* — Marc Carlson
(74) *Attorney, Agent, or Firm* — Anova Law Group, PLLC

(57) ABSTRACT

A chemical mechanical polishing apparatus includes a polishing zone having a wafer entrance and a wafer exit, first wafer platform, polishing module, slurry injection module, polishing cleaning module, and film-thickness measuring module. The first wafer platform includes a wafer loading region, and is able to move from the wafer entrance to the wafer exit along a first direction. The polishing module is located in the polishing zone, including a polishing belt extended along a second direction perpendicular to the first direction and is able to move along the second direction. The slurry injection module is configured for injecting slurry towards a wafer to-be-polished by the polishing module. The polishing cleaning module is located on one side of the polishing module along the first direction for cleaning the wafer. The film-thickness measuring module is located on another side of the polishing module along the first direction for measuring the thickness of the wafer.

20 Claims, 7 Drawing Sheets

(56) References Cited

U.S. PATENT DOCUMENTS

| | | | | |
|---|---|---|---|---|
| 6,413,873 | B1 * | 7/2002 | Li | B24B 1/04 438/711 |
| 6,468,134 | B1 * | 10/2002 | Gotkis | B24B 21/04 451/306 |
| 6,626,744 | B1 * | 9/2003 | White | B24B 21/04 451/168 |
| 6,837,774 | B2 * | 1/2005 | Hu | B24B 21/04 451/285 |
| 6,837,779 | B2 * | 1/2005 | Smith | B24B 37/26 451/285 |
| 6,890,245 | B1 * | 5/2005 | Kistler | B24B 21/04 451/444 |
| 7,153,182 | B1 * | 12/2006 | Taylor | B24B 21/10 451/5 |
| 2002/0068513 | A1 * | 6/2002 | Xu | B24B 37/205 451/41 |
| 2002/0090819 | A1 * | 7/2002 | Xu | B24B 37/205 438/690 |
| 2007/0212976 | A1 * | 9/2007 | McReynolds | B24B 21/004 451/5 |
| 2015/0133032 | A1 * | 5/2015 | Kubo | B24B 27/0061 451/5 |

* cited by examiner

CHEMICAL MECHANICAL POLISHING (CMP) APPARATUS AND METHOD

FIELD OF THE DISCLOSURE

The present disclosure relates to the field of semiconductor technology and, more particularly, relates to a chemical mechanical polishing (CMP ) apparatus and a chemical mechanical polishing method.

BACKGROUND

Referring to FIG. 1, a schematic diagram of a conventional apparatus for chemical mechanical polishing is shown. The conventional chemical mechanical polishing apparatus includes a rotatable platform 1, a polishing pad 2 covering the rotatable platform 1, a rotatable polishing head 3, and a slurry nozzle 4.

Taking the silicon wafer as an example, a conventional chemical mechanical polishing method can include the following steps: inverting the silicon wafer 5 to make the to-be polished surface of the silicon wafer 5 contacting to the polishing pad 2; pressing the polishing head against the silicon wafer 5; controlling the rotatable platform 1 and the polishing head 3 to rotate; controlling the slurry nozzle 4 to inject slurry 40 to the polishing pad 4; and applying a downward pressure on the polishing head 3 toward the silicon wafer 5. With the rotation of the rotatable platform 1, the slurry 40 flows into the gap between the polishing pad 2 and the to-be polished surface of the silicon wafer 5, and polishes the to-be polished surface of the silicon wafer 5 during the rotational movement of the silicon wafer 5.

During the polishing process, the surface of the polishing pad 2 is gradually being worn and becoming uneven. Therefore, in the polishing process, for a silicon wafer under a certain pressure and at a certain rotational speed, the polishing rate can change over time. Thus, a thickness uniformity of the polished wafer can be decreased. Since the existing chemical mechanical polishing process may lack an effective method for real-time monitoring the thickness of the silicon wafer, the information of the real-time thickness changing of the silicon wafer cannot be obtained. Thus, the problem that a worn polishing pad may significantly decrease the thickness uniformity of the polished silicon wafer may not be discovered in time. If a worn polishing pad is continually used for polishing wafers, it may cause a large number of scrapped wafers, and thereby can reduce the production yield.

The disclosed apparatus and methods are directed to solve one or more problems set forth above and other problems.

BRIEF SUMMARY OF THE DISCLOSURE

One aspect of the present disclosure provides a chemical mechanical polishing apparatus. The chemical mechanical polishing apparatus includes a polishing zone having a wafer entrance and a wafer exit, a first wafer platform, a polishing module, a slurry injection module, a polishing cleaning module, and a film-thickness measuring module. The first wafer platform includes a wafer loading region, and the first wafer platform is able to move from the wafer entrance to the wafer exit along a first direction. The polishing module is located in the polishing zone, including a polishing belt extended along a second direction that is perpendicular to the first direction, and the polishing belt is able to move along the second direction. The slurry injection module is configured for injecting slurry towards a wafer to-be-polished by the polishing module. Further, the polishing cleaning module is located on one side of the polishing module along the first direction, and the polishing cleaning module is used for cleaning the wafer. The film-thickness measuring module is located on another side of the polishing module along the first direction, and the film-thickness measuring module is used for measuring the thickness of the wafer.

Another aspect of the present disclosure provides a chemical mechanical polishing method. The method includes moving a first wafer from a wafer entrance to a polishing zone along a first direction and, in the polishing zone, moving the first wafer along the first direction, and simultaneously polishing the first wafer along a second direction. The first direction is perpendicular to the second direction. The method also includes continuously moving the first wafer along the first direction and polishing the first wafer along the second direction and simultaneously cleaning a polished portion of the first wafer; and continuously moving the first wafer along the first direction and polishing the first wafer along the second direction and simultaneously measuring a cleaned portion of the first wafer.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiments, persons of ordinary skill in the art may derive other embodiments consistent with the present disclosure, all of which are within the scope of the present invention.

Figure 1:
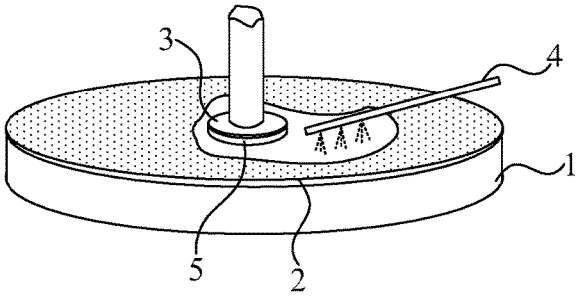
FIG. 1 (Prior Art)
FIG. 1 is a perspective view of a conventional chemical mechanical polishing apparatus in a polishing process.
Figure 2:
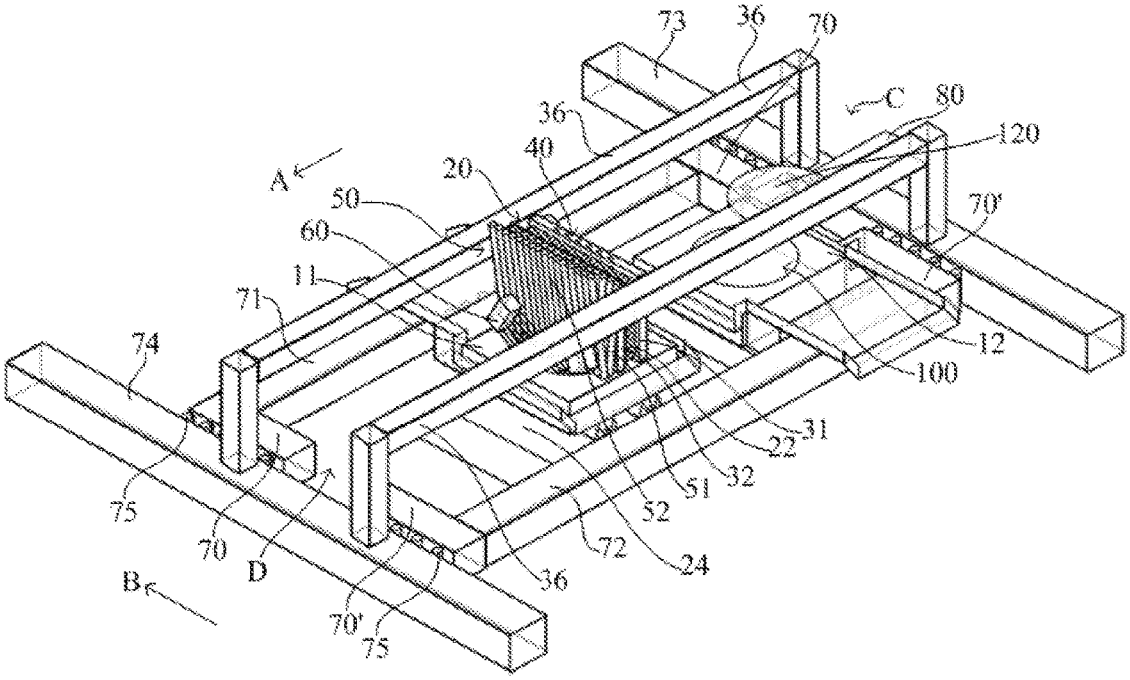
FIG. 2 is a perspective view of an exemplary chemical mechanical polishing apparatus in accordance with some embodiments of the disclosed subject matter.
Figure 3:
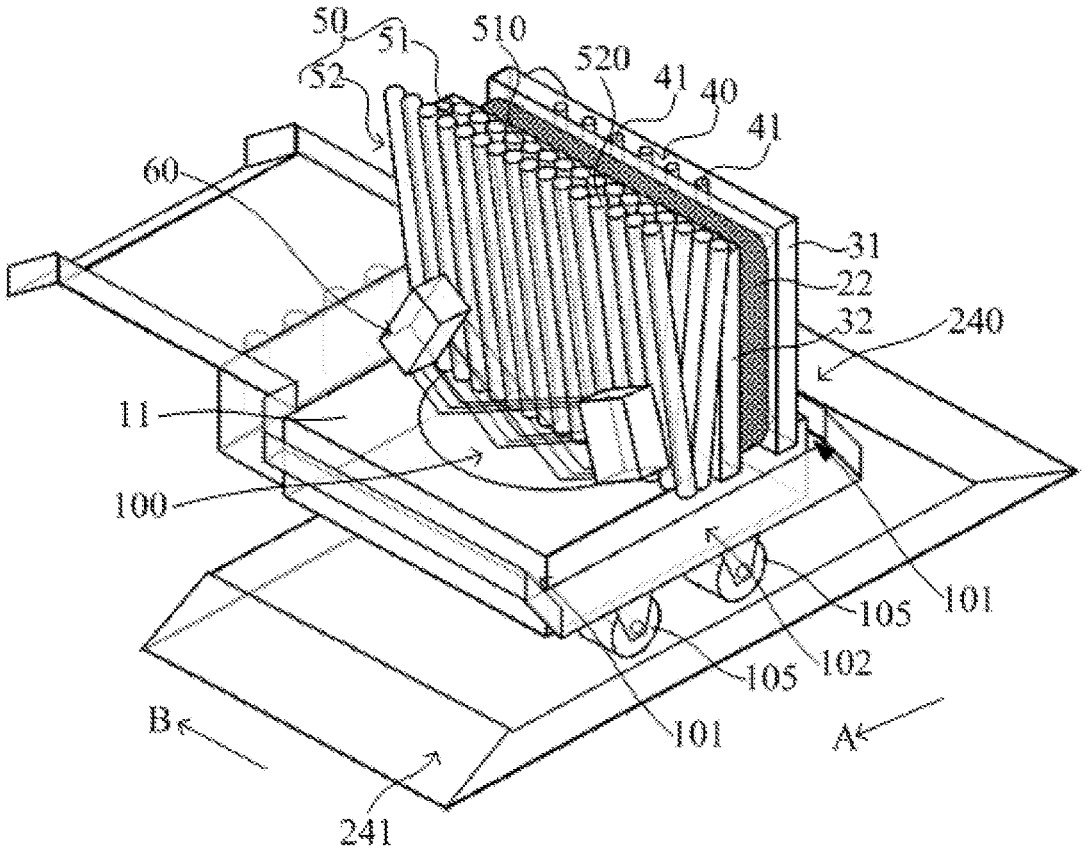
FIG. 3 is an enlarged perspective view of the exemplary chemical mechanical polishing apparatus shown in FIG. 2 in accordance with some embodiments of the disclosed subject matter.
Figure 4:
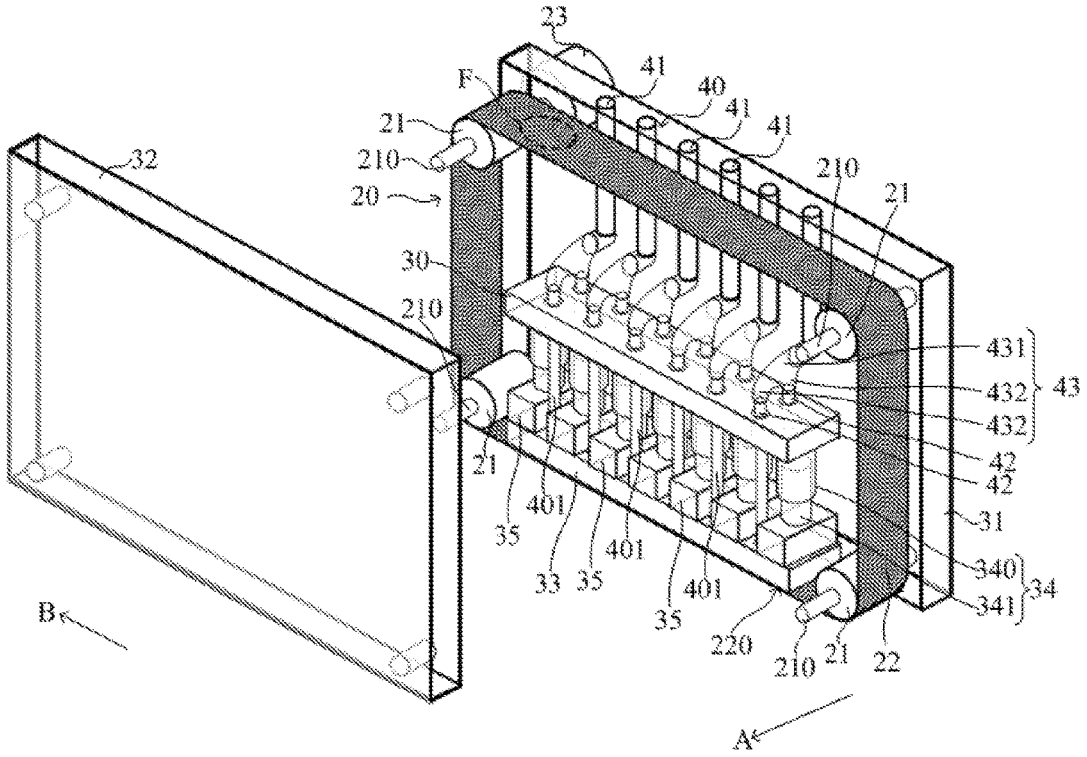
FIG. 4 is an perspective view of a polishing module that is connected with a first support member and separated from a second support member of the exemplary chemical mechanical polishing apparatus shown in FIG. 2 in accordance with some embodiments of the disclosed subject matter.

Referring to FIGS. 2-4, the structure of an exemplary chemical mechanical polishing apparatus are shown in accordance with some embodiments of the disclosed subject matter. As illustrated in FIGS. 2-4, the disclosed chemical mechanical polishing apparatus can include a polishing zone (not labelled), a first wafer platform 11 and a second wafer platform 12, a polishing module 20 in the polishing zone, a slurry injection module 40, a polishing cleaning module 50, and a film-thickness measuring module 60. Certain components may be omitted and other components may be added.

The polishing zone may include a wafer entrance C and a wafer exit D. A first direction A is defined as the direction pointing from the wafer entrance C to the wafer exit D.

Each of the first wafer platform 11 and the second wafer platform 12 may have a wafer loading region 100. A to-be-polished wafers can be placed in one wafer loading region 100. Both of the two wafer platforms 11 and 12 are able to move along the first direction A.

Further, the polishing module 20 can include four pulleys 21, and a polishing belt 22 set on the pulleys 21. The four pulleys 21 are connected with a first support member 31 and a second support member 32. The four pulleys 21 can rotate along their axes arranged in the first direction A. The four pulleys 21 can roll between the first support member 31 and the second support member 32 to drive the rotation of the polishing belt 22. The axial direction of the four pulleys 21 can be parallel to the first direction A, and the two lower pulleys 21 can be arranged along a second direction B that is perpendicular to the first direction A. During the rotating process, the polishing belt 22 can form a region (hereinafter referred to as the polishing head 220) under the polishing belt 22 along the second direction B that the polishing belt 22 can repeatedly pass through, i.e., a moving polishing zone or polishing head 220. The polishing head 220 can be used for the polishing the wafer-to-be-polished.

Further, the slurry injection module 40 is configured for injecting slurry to the polishing head 220 of the polishing module 20. The polishing cleaning module 50 is located along the first direction A, and is opposite to the polishing module 20. The second support member 32 is located between the polishing cleaning module 50 and the polishing module 20.

The chemical mechanical polishing apparatus can further include the film-thickness measuring module 60 for measuring the thickness of the cleaned region of the to-be-polished wafer. The film-thickness measuring module 60 may be located on one side of the polishing cleaning module 50 along the first direction A that is opposite to the second support member 32.

Using the first wafer platform 11 as an example, an exemplary chemical mechanical polishing method using the disclosed chemical mechanical polishing apparatus can include the following steps.

First, a to-be-polished wafer can be placed on the wafer loading region 100 of the first wafer platform 11 through the wafer entrance C. The to-be-polished surface of the to-be-polished wafer can face up. The wafer can then be transported from the wafer entrance C to the polishing zone along the first direction A. The wafer can be fixed on the first wafer by using a vacuum suction method or an electromagnetic adsorption method. For example, a vacuum tube can be set up in the wafer loading region 100. When a wafer is placed in the wafer loading region 100, the vacuum tube can attach the back surface of the wafer to fix the wafer.

Next, the first wafer platform 11 can continually move along the first direction A in the polishing zone, while the polishing belt 22 can be controlled to repeatedly move along the second direction B to polish the wafer. At the same time, the slurry injection module 40 is controlled to inject slurry into the polishing head 220. The polishing belt 22 may be continually rotating along one direction, or may be periodically rotating along opposite directions alternately. For example, the polishing belt 22 can make a forward rotation for one revolution and then make a reverse rotation for another revolution, and these motions can be repeated. The alternate rotation of the polishing belt 22 can eliminate the asymmetric of the wafer surface caused by a unidirectional movement of the polishing belt 22.

While the first wafer platform 11 is continually moving along the first direction A, the polishing cleaning module 50 can be controlled to clean the polished region of the wafer that is moved outside from the polishing belt 22. The slurry remained on the wafer surface can be removed to ensure a measuring accuracy of the wafer thickness performed by the film-thickness measuring module 60 in the subsequent process.

While the first wafer platform 11 is continually moving along the first direction A, the film-thickness measuring module 60 can be controlled to measure the thickness of polished region of the wafer.

When the wafer is completely polished and transported to the wafer exit D, the first wafer platform 11 can be moved out from the polishing zone along the second linear B through the wafer exit D.

Throughout the entire chemical mechanical polishing process, the wafer is being polished, cleaned, and measured simultaneously. Since the first wafer platform 11 is constantly moving, the film-thickness measuring module 60 can monitor the thickness of the different portions of the wafer that are polished in real time.

During the chemical mechanical polishing process, based on the thickness of the polished wafer measured in real time, multiple parameters can be adjusted. For example, a moving speed of the first wafer platform 11, a pressure applied from the polishing belt 22 on the wafer, and other suitable parameters can be adjusted for controlling the to-be-polished amount of the wafer during the polishing process. Therefore, a target thickness of the wafer can be obtained from the chemical mechanical polishing process.

If the moving speed of the first wafer platform 11 along the first direction A is too fast, the to-be-polished wafer can fast pass through the polishing belt 22, so that the wafer can be polished in a short time and can be too thick. Conversely, if the moving speed of the first wafer platform 11 along the first direction A is too slow, the to-be-polished wafer can slowly pass through the polishing belt 22, so that the wafer can be polished in a long time and can be too thin.

If the applied pressure from the polishing belt 22 on the wafer is too large, there is a large friction between the polishing belt 22 and the wafer, so that the wafer can have a large polished amount and can be too thin. If the applied pressure from the polishing belt 22 on the wafer is too small, there is a small friction between the polishing belt 22 and the wafer, so that the wafer can have a small polished amount and can be too thick.

In addition, a larger friction between the polishing belt 22 and the wafer can decrease the rotating speed of the polishing belt 22 and the moving speed of the first wafer platform 11, thereby affecting the polished amount of the wafer. During the polishing process, the parameters including the rotating speed of the polishing belt 22, the moving speed of the first wafer platform 11, the pressure applied from the polishing belt 22 on the wafer, and other suitable parameters can be controlled to obtain an optimum polishing effect, based on at least the thickness of the wafer measured in real-time.

Therefore, by monitoring the thickness of the polished wafer in real time, the polished amount of wafer can be adjusted in time to control the thickness of the wafer. The disclosed method can improve the yield of the polished wafers, reduce an amount of the wasted wafer, and reduce the manufacturing cost.

Further, if a wafer thickness measured by the film-thickness measuring module 60 is much larger than a target thickness during the polishing process, it can be assumed that the outer surface of the polishing belt 22 has been excessively worn and become smooth. So the friction between the polishing belt 22 and the wafer can be too small, resulting in a too small polished amount of wafer. In such case, the polishing process can be immediately stopped, and a timely replacement of polishing belt 22 can be performed. The wafer can be polished by using the new polishing belt 22 to ensure a successful polishing process. Therefore, the film-thickness measuring module 60 can timely discover the extreme cases during the polishing process, improving the production efficiency.

In some embodiments, during the polishing process, corresponding to the constantly moving of the first wafer platform 11, multiple thickness values of different portions of the wafer can be obtained and recorded in real time. After the polishing process, based on the multiple thickness values of different portions of the wafer, a thickness distribution uniformity of the wafer can be obtained and compared with a standard value of the desired thickness distribution uniformity of the polished wafer. In order to improve the accuracy of the measured thickness distribution uniformity of the wafer, multiple film-thickness measuring modules 60 can be set up around the polishing zone, so that the area can be measured is increased, and more thickness values corresponding to the increased area can be obtained.

By comparison, if the thickness distribution uniformity of a polished wafer satisfies the standard value, it can be determined that the polished wafer is a qualified product. If the thickness distribution uniformity of a polished wafer does not satisfy the standard value, the polished wafer can be filtered out. And before the next polishing process, in order to ensure the thickness distribution uniformity of the next wafer satisfying the standard value, multiple parameters of the polishing module 20, the polishing liquid composition, the wafer platform, etc., can be checked to find and solve the problem. Accordingly, the disclosed method is able to timely avoid generating a large quantities of waste wafers, improving the product yield and reducing the production costs.

It should be noted that, the process for comparing the thickness distribution uniformity with the standard value is completely automated, which requires a short process time and does not affect the productivity.

In some embodiments, the thickness distribution uniformity of a polished wafer can be measured by using an ellipsometry method, and the film-thickness measuring module 60 is an ellipsometer. The structure of the ellipsometer can include a light source, a polarizer, a polarization analyzer and a detector. A process of the ellipsometry method can include the following steps.

First, the light source emits a non-polarized light. In order to ensure that the non-polarized light can be transmitted into the to-be-polished wafer, a wavelength of the non-polarized light can be determined based on the material of the to-be-polished wafer.

Next, the non-polarized light enters the polarizer. After the linear polarization effected by the polarizer, the outgoing light becomes a linearly polarized light with equal amplitude and equal phase.

Then, the linearly polarized light incidents into the wafer and pass through the wafer. The transmitted light from the wafer is an elliptically polarized light, and can be detected by the polarization analyzer.

After that, the detector can receive the elliptically polarized light emitted from the polarization analyzer. Finally, the outgoing elliptically polarized and the incident linearly polarized light can be analyzed to calculate the attenuation of light in different directions. Based on that, the thickness of the wafer can be calculated. In some embodiments, in order to obtain the thickness distribution uniformity of a polished wafer, multiple polarization analyzers and corresponding detectors can be set up around the moving area of the wafer to measure the thickness values of multiple portions of the polished wafer. The thickness distribution uniformity of the polished wafer can be accurately measured by using the ellipsometry method.

In some embodiments, in order to ensure that all regions of the wafer on the wafer loading region 100 can be polished, a size of the polishing belt 22 along the second direction B is greater than or equal to a maximum size of the wafer loading region 100 along the second direction B.

In the polishing module 20, the axially opposite ends of each pulley 21 are respectively connected to the first support member 31 and the second support member 32 through two horizontal axes 210. Each horizontal axis 210 extends into a groove of the corresponding supporting member and is capable of rotating in the groove.

For example, one horizontal axis 210 corresponding to the pulley 21 (refer to the pulley 21 in the upper left corner shown in FIG. 3 and FIG. 4) extends out of the first support member 31 and is connected to the driving module 23. The driving module 23 can drive the pulley 21 to rotate and drive the polishing belt 22 to rotate. The driving module 23 may be fixedly amounted on one surface of the first support member 31 that is along the first direction A and facing away from the polishing module 20. The illustrated mounted position is for example only, and the installation can be adapted to the specific need. The driving module 23 can be a driving motor. An output terminal of the driving module 23 can be connected to the horizontal axis 210.

In some other embodiments, the polishing module 20 can be a plate-like structure extended in the second direction B. By using a driving module to control the plate-like structure repeatedly moving in the polishing zone along the second direction, the polishing module 20 can polish the wafer placed on the moving wafer loading platform. The driving module can be a rotary motor driver or a linear motor driver.

Referring to FIGS. 2 to 4, the first support member 31 and the second support members 32 are plate-like members that are securely fixed on the two beams 36 along the second direction B. The first support member 31 and the second support members 32 can be suspended for keeping an enough space to allow the wafer loading platform going through from the bottom of the polishing head 220.

The slurry injection module 40 can include multiple slurry injection tubes 41 arranged separately apart in the first support member 31 along the second direction B. The multiple slurry injection tubes 41 are connected to multiple slurry discharge pipes 42 that are aligned towards the inner surface of the polishing belt 22 in the region of the polishing head 220. The slurry injection module 40 can inject the slurry through the slurry injection tubes 41 and the slurry discharge pipes 42 towards the polishing belt 22 for polishing the wafer.

Figure 5:
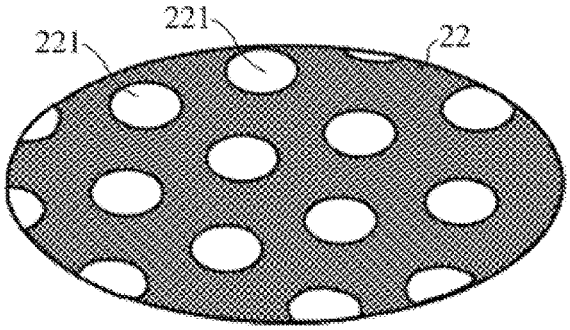
FIG. 5 is an enlarged schematic view of the structure of region F of the exemplary chemical mechanical polishing apparatus shown in FIG. 4 in accordance with some embodiments of the disclosed subject matter.

Referring to FIG. 5, an enlarged schematic view of the structure of region F of the exemplary chemical mechanical polishing apparatus shown in FIG. 4 is illustrated. Multiple via holes 221 are distributed in the polishing belt 22 along the circumferential direction. The multiple via holes 221 are used for exits of the slurry. During the polishing process, the slurry flows out from the multiple via holes 221 to the gap between the wafer and the outer surface of the polishing belt for polishing.

It should be noted that, in addition to the slurry injection tubes 41 shown in FIGS. 2 to 4, any other suitable components can be included in the slurry injection module 40. The installation can be adapted to the specific need.

As illustrated in FIGS. 3 and 4, the slurry injection tubes 41 are embedded in the first support member 31. The input ports of the slurry injection tubes 41 are located on the surface of the first support member 31. The illustrated arrangement is used for of example only, and can be adjusted according to specific need. The slurry injection tubes 41 are spaced apart along the second direction B, and are extended to the region in where the polishing belt 22 is repeatedly moving back and forth along the second direction B. The purpose is to ensure a uniform distribution of the slurry throughout the polishing head 220, so that the wafer can be uniformly polished with an even polishing rate.

Referring to FIG. 4, each output port of the slurry injection tubes 41 is interconnected to slurry discharge tube 42 through a connector devices 43. Each connector device 43 includes an inlet tube 431, and two output tubes 432 interconnected with the inlet tube 431. The slurry can be input from the inlet tube 431 and be output from the two output tubes 432. The inlet tube 431 is interconnected with the output port of the slurry injection tube 41. Each output tube 432 is interconnected with a slurry discharge tube 42. By using the connector devices 43, more slurry discharge tubes 32 can be disposed in the region of the polishing belt 22 corresponding to the polishing head 220. Therefore, a slurry discharging area can be increased for providing a uniform injecting result.

In the space surrounded by the polishing belt 22, a holder 30 can be disposed opposite with the polishing head 220. The holder 30 is fixedly connected with the first support member 31 and the second support member 32. All slurry discharge pipes 42 penetrate through the holder 30 towards the polishing zone of the polishing belt 22.

A pressure supplier 34 and a pressure plate 33 are disposed between the holder 30 and the polishing head 220. The pressure plate 33 is located opposite to the inner surface of the polishing belt 22 in the region of the polishing head 220. The pressure supplier 34 is connected to both of the holder 30 and the pressure plate 33. The pressure supplier 34 is used for controlling a pressure applied on the pressure plate 33 towards the polishing belt 22, and adjusting the pressure from the polishing belt 22 to the wafer during the polishing process.

Referring to FIG. 4, multiple pressure suppliers 34 can be disposed. Each pressure supplier 34 is connected to the pressure plate 33 by a pressure block 35. The pressure suppliers 34 can be hydraulic cylinders or pneumatic cylinders. Each pressure supplier 34 includes a hollow cylinder 340 and a piston rod 341 extending into the cylinder 340. The piston rod 341 extends outside of the cylinder 340 and is connected to the pressure block 35. One end of the cylinder 340 that is not connected to the piston rod 341 can be fixed on the holder 30.

The pressure suppliers 34 can be used for adjusting the pressures applied on the wafer. According to the type of a pressure supplier 34, the amount of gas or liquid within the cylinder 340 can be controlled to adjust the pressure on the piston rod 341 from the gas or liquid. The pressure applied on the piston rod 341 can be transmitted to the wafer through the pressure plate 33 and the pressure block 35. For example, in order to increase the polishing amount of the wafer, gas or liquid can be fed into the cylinder 340 to increase the pressure from the polishing belt 22 to the wafer. In order to decrease the polishing amount of the wafer, gas or liquid can be discharged from the cylinder 340 to decrease the pressure from the polishing belt 22 to the wafer.

During the polishing process, the pressure suppliers 34 can be adjusted to control the pressure from the polishing belt 22 to the wafer, and to control the polishing rate and the polishing amount of the wafer. Additionally, a pressure sensor (not shown in the figures) can be set up to monitor the pressure from the polishing belt 22 to the wafer during the polishing process. Based on the information obtained from the pressure sensor, the pressure from the polishing belt 22 to the wafer can be controlled during the polishing process, so that the polishing rate and polishing amount of wafer can be accurately controlled in real time. The pressure sensor can be installed on the pressure suppliers 34, the pressure plate 33, or the wafer loading region 100 of the wafer loading platform.

In some embodiments, the pressure suppliers 34 can be connected with a peripheral hydraulic or pneumatic control device to accurately adjust the pressure from the pressure suppliers 34 to the pressure plate 33. In addition to the pneumatic cylinder or the hydraulic cylinder, in some other embodiments, electromagnetic controlled pressure suppliers can be used. The electromagnetic forces can be used to adjust the movement of the piston rods, and to adjust the pressure from the polishing belt 22 to the wafer.

Referring to FIG. 3, the polishing cleaning module 50 is located on one side of the second support member 32 along the first direction A that is opposite to the polishing module 20. The polishing cleaning module 50 is used for timely cleaning the polished wafer during the polishing process. The polishing cleaning module 50 can include a washing module 51 for washing the polished wafer, and a drying module 52 for drying the washed wafer. The drying module 52 is located one side of the washing module 51 along the first direction A that is opposite to the second support member 32. During the polishing process, the washing module 51 can wash the polished region of the wafer, while the drying module 52 can dry the washed region of the wafer. The wind from the drying module 52 can blow away the cleaning fluid and the slurry to prevent the cleaning fluid and the slurry from affecting the measurement accuracy of the film-thickness measuring module 60 in the subsequent process.

The washing module 51 can include multiple cleaning fluid pipes 510 arranged along the second direction B. The inlet ports of the cleaning fluid pipes 510 are interconnected to a peripheral cleaning fluid supply module, the outlet ports of the cleaning fluid pipes 510 are aligned with the region between the drying module 52 and the polishing head 220. During the polishing process, cleaning fluid can be sprayed from multiple cleaning fluid pipes 510 towards the polishing region of the wafer. All of the cleaning fluid pipes 510 can be integrated into the second support member 32, or can be attached to the surface of the second support member 32. In addition, referring to FIG. 2, all the cleaning fluid pipes 510 can also be independent from the second support member 32. The cleaning fluid pipes 510 can be interconnected to each other, and be installed on the two beams 36 along the second direction B.

The cleaning fluid pipes 510 can be arranged inclined from top to bottom relative to a plane that is perpendicular to the second direction B. So the cleaning fluid pipes 510 can spray the cleaning fluid along the second direction B toward the outside of the polishing region. With the injecting pressure, the cleaning liquid can flush the slurry out from the polishing region along the second direction B, which has a high cleaning efficiency. Further, the vertical axis of the cleaning fluid pipes 510 are perpendicular to the first direction A. So the cleaning fluid cannot be sprayed along the first direction A from the cleaning fluid pipes 510 towards the polishing module 40 or the drying module 52. This design can prevent the cleaning fluid from being sprayed into the polishing region to interfere with the polishing process, and can also prevent the cleaning fluid from being sprayed into the film-thickness measuring region to increase the film-thickness measurement error.

The drying module 52 can include multiple air pipes 520 arranged along the second direction B. The inlet ports of the air pipes 520 are interconnected with a peripheral air supply device. The outlet ports of the air pipes 520 are aligned along the first direction A towards a region corresponding to cleaning fluid pipes 510 that is opposite to the polishing belt 22. During the polishing process, the multiple air pipes 520 can blow air to dry the washed region of the wafer. All of the air pipes 520 can be integrated together with the cleaning fluid pipe 510, and then be connected to the second support member 32. The air pipes 520 can also be installed on the two beams 36.

The air pipes 520 can be arranged inclined from top to bottom relative to a plane that is perpendicular to the second direction B. So the air pipes 520 can blow the air along the second direction B toward the outside of the polishing region. So the air can blow the cleaning fluid and the slurry out from the polishing region along the second direction B. Further, the vertical axes of the air pipes 520 are perpendicular to the first direction A. So the air cannot be blown along the first direction A from the air pipes 520 towards the polishing module 40 or the polishing cleaning module 50. This design can prevent the cleaning fluid and other impurities from being blown back to decrease the cleaning efficiency, and can also prevent the cleaning fluid and other impurities from being blown into the film-thickness measuring region to increase the film-thickness measurement error.

In some embodiments, referring to FIGS. 2 and 3, one or more guide grooves 101 can be set up on the first wafer platform 11 and the second wafer platform 12. The one or more guide grooves 101 are used for collecting the cleaning fluid and the slurry flowed from the wafer loading region 100 during the polishing process. Specifically, taking the first wafer platform 11 as an example, the guide grooves 101 can be provided around the wafer loading region 100 on the first wafer platform 11. Two guide openings or exports 102 of the guide grooves 101 can be located opposite with each other along the second direction B.

During the polishing process, the slurry and the cleaning fluid can flow from the wafer loading region 100 into the guide grooves 101, and flow out from the two exports 102 of the guide grooves 101 without splashing. Moreover, corresponding to the direction of the inclined cleaning fluid pipes 510, the cleaning fluid pipes 510 can spray the cleaning fluid towards the direction of the exports 102, so that the slurry and the cleaning fluid can be flushed out fast enough from the exports 102. Similarly, the corresponding to the direction of the inclined air pipes 520, the air pipes 520 can blow air towards the direction of the exports 102, so that the slurry and the cleaning fluid can be flushed out fast enough from the exports 102. Further, the exports 102 are arranged along the second direction B in order to prevent the slurry and the cleaning fluid flowing the moving path of the wafer platform.

Referring to FIG. 2, in some embodiments, the chemical mechanical polishing apparatus can further comprise a first linear guide 71 and a second linear guide 72. The first linear guide 71 and the second linear guide 72 are extended along the first direction A, and are opposite to each other in the second direction B. The polishing region is between the first linear guide 71 and the second linear guide 72. The polishing module 20, the polishing cleaning module 50, and the film-thickness measuring module 60 are all located in a region between the first linear guide 71 and the second linear guide 72. The first wafer platform 11 is slidably connected to the first linear guide 71, and the second wafer platform 12 is slidably connected to the second linear guide 72. The first wafer platform 11 can move back and forth along the first linear guide 71, and the second wafer platform 12 can move back and forth along the second linear guide 72.

In some embodiments, the chemical mechanical polishing apparatus can further comprise a third linear guide 73 and a fourth linear guide 74. The second linear guide 73 and the fourth linear guide 74 are extended along the second direction B, and are opposite to each other in the first direction A. The third linear guide 73 is located on the same side of the wafer entrance C, and the fourth linear guide 74 is located on the same side of the wafer exit D. The two ends of the first linear guide 71 are connected to the second linear guide 73 and the fourth linear guide 74 through two sliders 70. The two ends of the second linear guide 72 are connected to the second linear guide 73 and the fourth linear guide 74 through two sliders 70'. The first linear guide 71 can move back and forth along the second linear guide 73 and the fourth linear guide 74 through two sliders 70. The second linear guide 72 can move back and forth along the second linear guide 73 and the fourth linear guide 74 through two sliders 70'.

Referring to FIGS. 6-13, perspective views of the exemplary chemical mechanical polishing apparatus shown in FIG. 2 at certain stages of an exemplary chemical mechanical polishing method are illustrated in accordance with some embodiments of the disclosed subject matter.

As shown in FIG. 2, a wafer can be placed on the first wafer platform 11. The first wafer platform 11 can be controlled to move along the first linear guide 71 in the first direction A to the polishing region. During the moving process, the wafer can be polished, cleaned, and measured simultaneously. At the same time, the second wafer platform 12 can be put on the wafer entrance C. Using a mechanical arm 80, a to-be-polished wafer 120 can be placed in the wafer loading region 100 of the second wafer platform 12.

Figure 6:
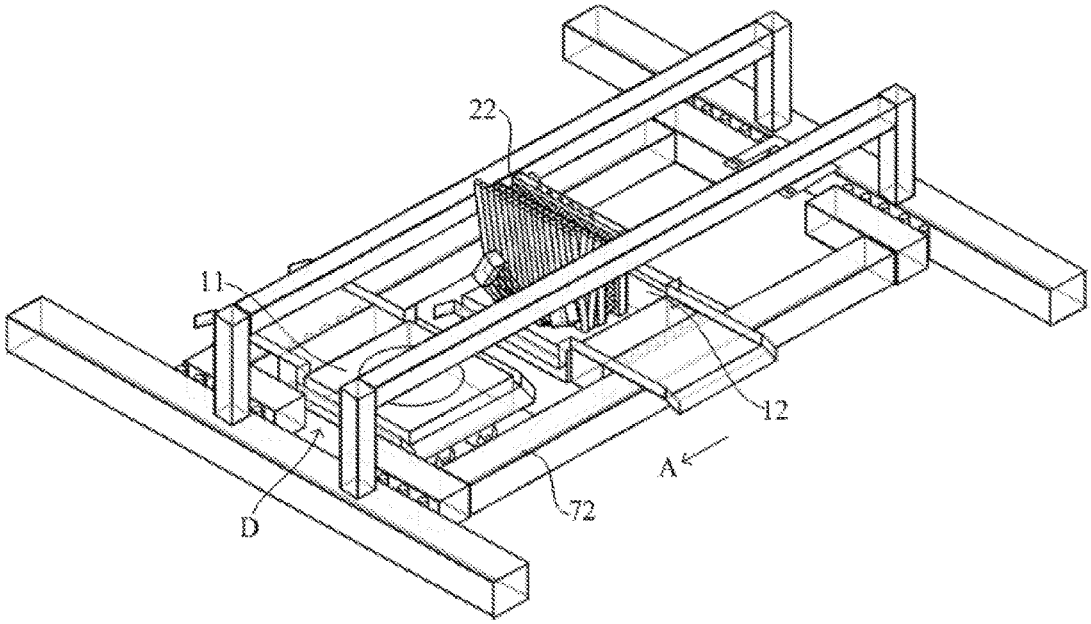
FIGS. 6-13 are perspective views of the exemplary chemical mechanical polishing apparatus shown in FIG. 2 at certain stages of an exemplary chemical mechanical polishing method in accordance with some embodiments of the disclosed subject matter.

Referring to FIG. 6, after completing the polishing process on the wafer on the first wafer platform 11, the first wafer platform 11 can be controlled to move to the wafer exit D. At the same time, the second wafer platform 12 can be controlled to move along the second linear guide 72 in the first direction A to the polishing region. During the moving process, the wafer on the second wafer platform 12 can be polished, cleaned, and measured simultaneously.

Figure 7:
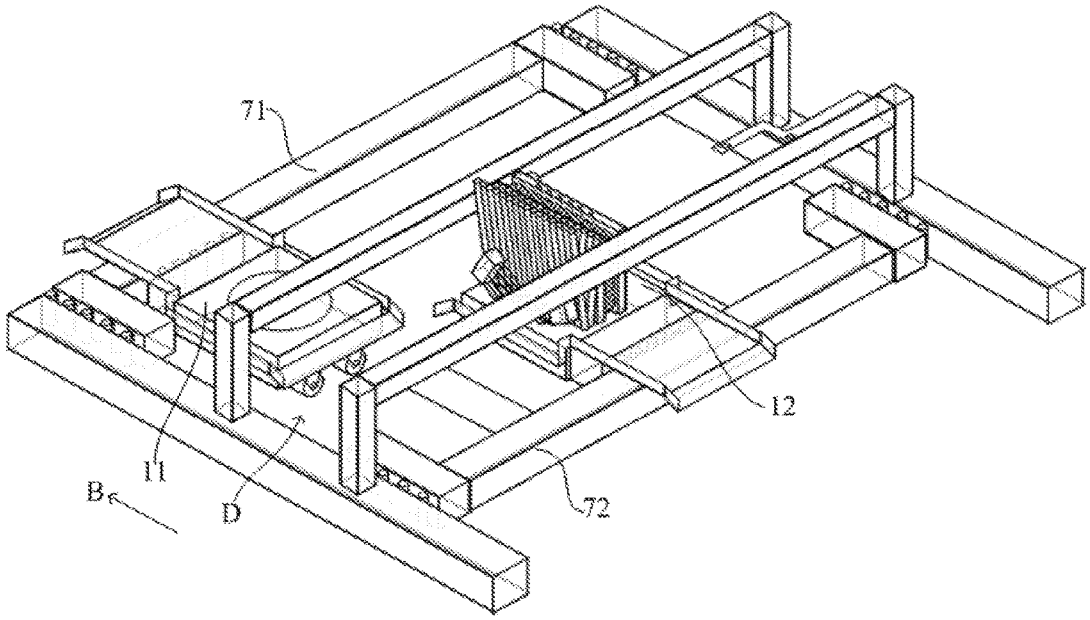

Referring to FIG. 7, the first linear guide 71 can be controlled to move away from the second linear guide 72 in the second direction B along the third and fourth linear guides, until the first wafer platform 11 moves out from the wafer exit D. In the same time, the second wafer platform 12 is continuously moving for polishing the wafer on the second wafer platform 12.

Figure 8:
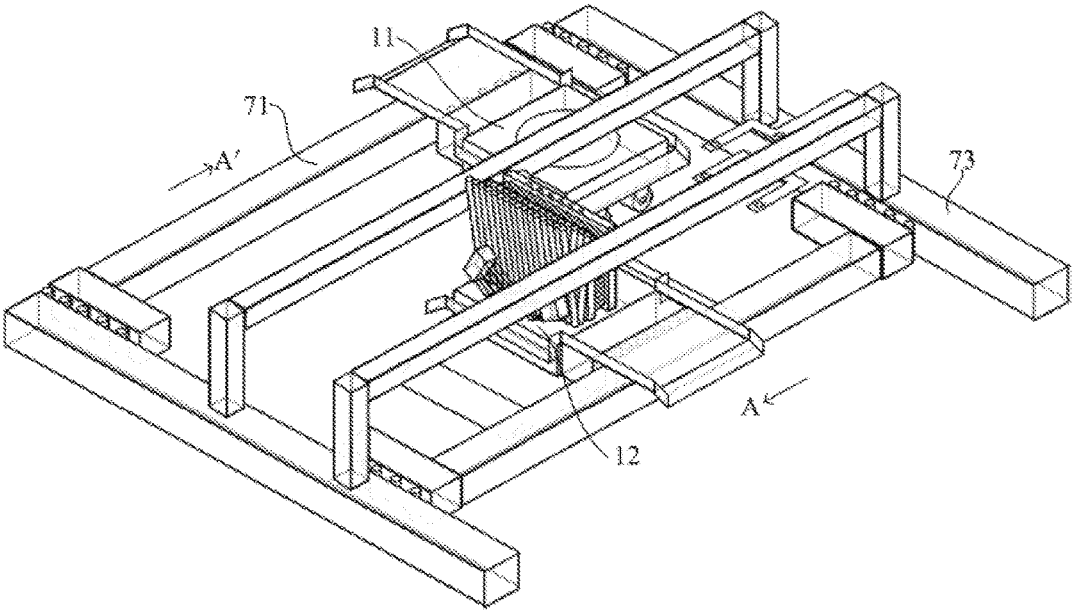

Referring to FIG. 8, the first wafer platform 11 is controlled to move along the first linear guide 71 towards the third linear guide 73 in the direction A' that is opposite to the first direction A. In the same time, the second wafer platform 12 is continuously moving for polishing the wafer on the second wafer platform 12.

Figure 9:
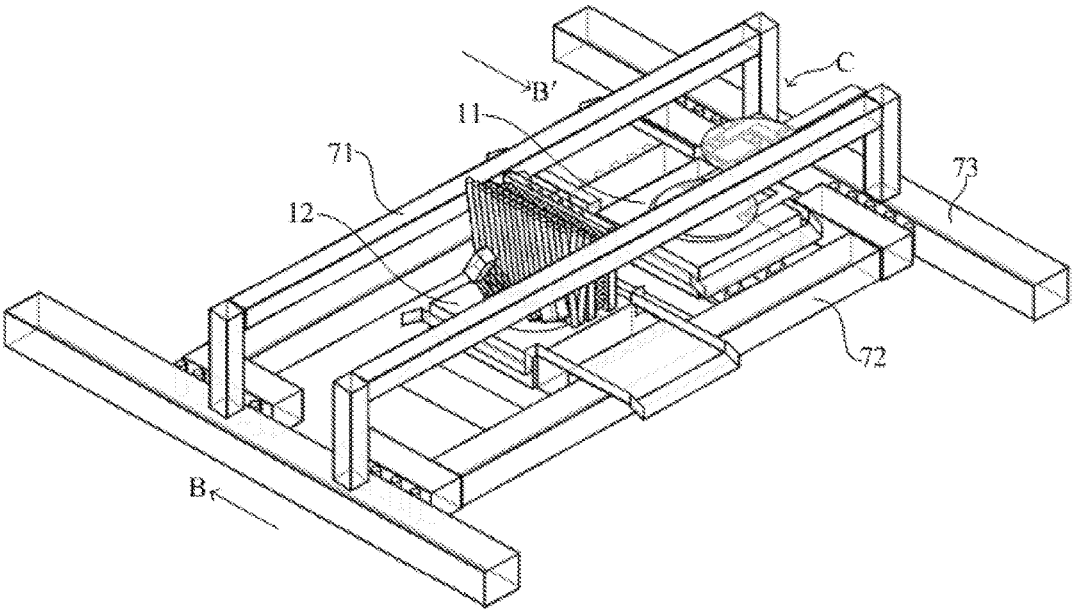

Referring to FIG. 9, when the first wafer platform 11 reaches the third linear guide 73, the first linear guide 71 can be controlled to move along the third and fourth linear guides towards the second linear guide 72 in the direction B' that is opposite to the second direction B, until the first wafer platform 11 reaches the wafer entrance C. At the same time, the second wafer platform 12 is continuously moving for polishing the wafer on the second wafer platform 12.

Figure 10:
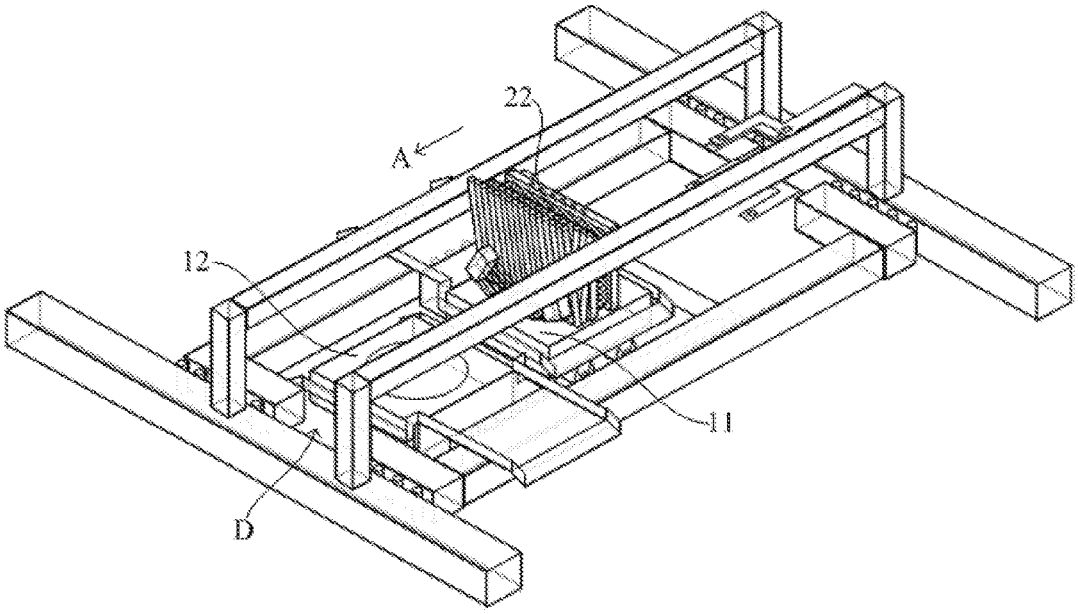

Referring to FIG. 10, after the wafer on the second wafer platform 12 completing the polishing process, the second wafer platform 12 can be controlled to move to the wafer exit D. At the same time, the first wafer platform 11 can be controlled to move along the first direction A to the polishing region. During the moving process, the wafer on the first wafer platform 11 can be polished, cleaned, and measured simultaneously.

Figure 11:
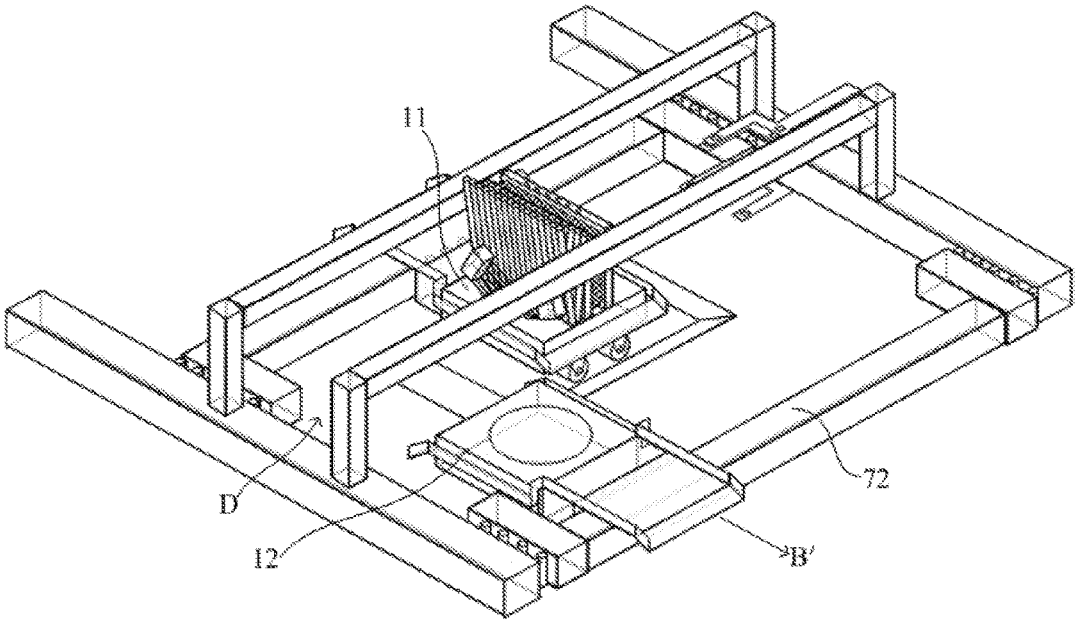

Referring to FIG. 11, the second linear guide 72 can be controlled to move along the direction B' until the second wafer platform moves out from the wafer exit D. At the same time, the first wafer platform 11 is continuously moving for polishing the wafer on the first wafer platform 11.

Figure 12:
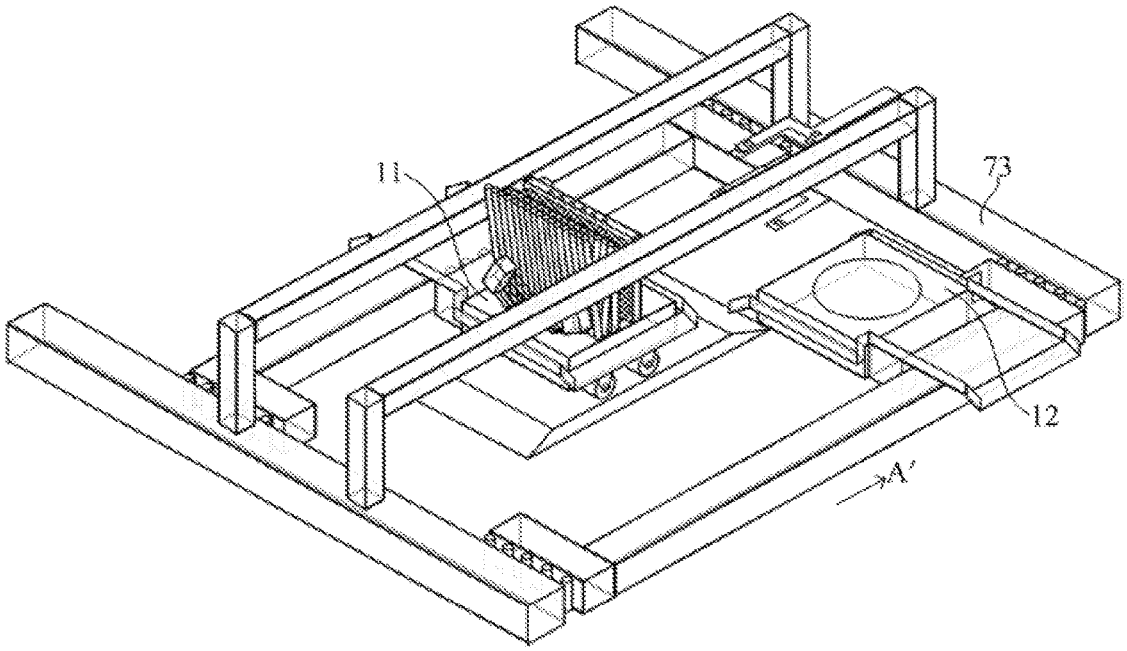

Referring to FIG. 12, the second linear guide 72 can be controlled to move along the direction B' until the second wafer platform moves out from the wafer exit D. At the same time, the first wafer platform 11 is continuously moving for polishing the wafer on the first wafer platform 11.

Figure 13:
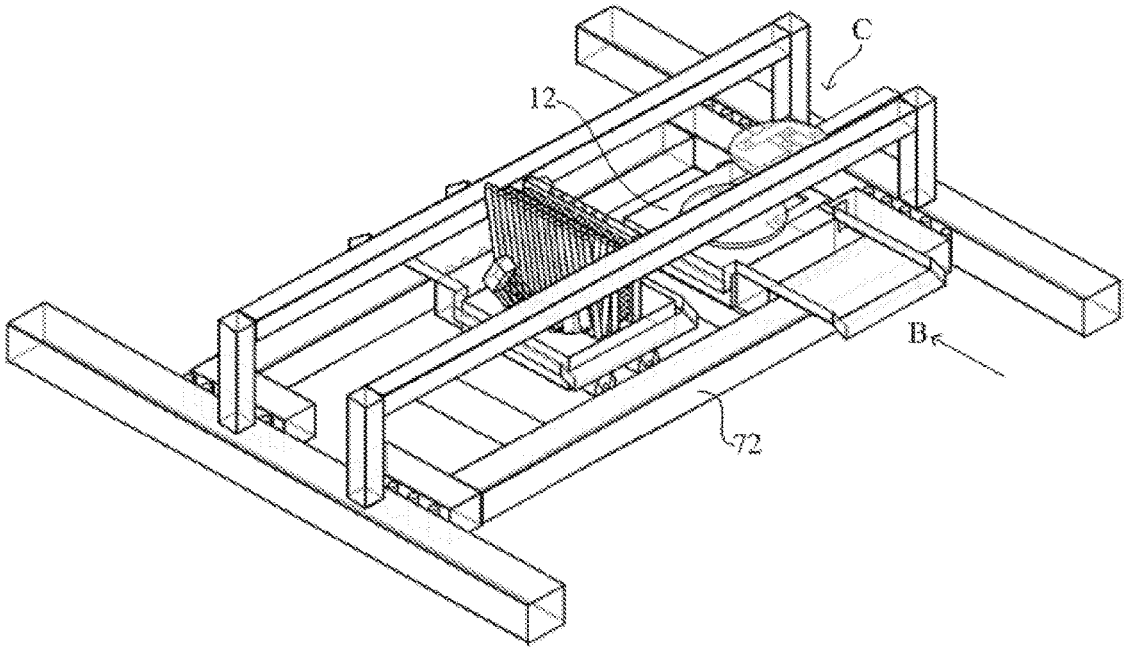

Referring to FIG. 13, the second linear guide 72 can be controlled to move along the second direction B until the second linear guide 72 reaches the wafer entrance C to load the next to-be-polished wafer.

The above processes can be repeated. The first wafer platform 11 and the second wafer platform 12 can be alternately used for loading, moving, and polishing wafers. By using the disclosed method, a large-scale wafer polishing process can be achieved.

In some embodiments, the first, second, third and fourth linear guides can be integrated with driving devices (not shown in the figures). The output terminals of the driving devices can be connected to the corresponding sliders respectively. The driving devices can drive the corresponding sliders to control the movement of the linear guides and thereby control the movement of the wafer platforms. The driving devices may be linear motors. The output terminals of the linear motors can be directly connected with the corresponding sliders. The driving devices may also be rotating motors. The output terminals of the rotating motors can be connected with corresponding sliders through worm gears. The output torque of each rotating motor can be transformed to linear motion through a worm gear.

The first wafer platform 11 is on the first linear guide 71, and the second wafer platform 12 is on the second linear guide 72. The first and second linear guides can roll back and forth on the third and fourth guides. Referring to FIG. 2, taking the fourth linear guide 74 as an example, one or more rollers 75 can be mounted on the sliders 70 and 70' on the fourth linear guide 74. The one or more rollers 75 are located in the guide groove of the fourth linear guide 74, and can roll back and forth in the guide groove along the second direction B. In addition to the rolling movement, the one or more rollers 75 may also be sliding in the guide groove.

Referring to FIGS. 2 and 3, a base 24 can be provided below the polishing module 20. The base 24 has two slopes 240 and 241 along the first direction A and are opposite with each other. The slope 240 faces the wafer entrance C, and the slope 241 faces the wafer exit D. The base 24 can support the wafer platforms when they are moving during the polishing process. Therefore, the wafer can be polished under an even pressure during the polishing process, and can be uniformly polished to obtain a uniformly distributed thickness. Additionally, the pressure applied to the wafer platform can be transformed to the base 24. The base 24 can be used for burdening a large pressure, so that the connecting parts between the wafer platforms and the linear guides do not suffer a pressure and would not break due to the pressure.

Further, rollers 105 can be provided at the bottom of the wafer platforms. The axes of the rollers 105 are parallel to the second direction B. Using the rollers 105, the wafer platforms can move up to the base 24 along the slope 240, and can move down from the base 24 along the slope 241. During the polishing process, the rollers 105 can roll on the base 24, and the wafer platforms can move on the base 24 through the supporting of the rollers 105. Since the rolling friction is small, the wafer platforms can suffer a small resistance when moving on the base 24. Thus, the wafer platforms can move smoothly, thereby enhancing the polishing efficiency. Before the wafer platforms enter the polishing zone and after the wafer platforms leave the polishing zone, the rollers 105 can be floating in the air.

In some embodiments, the rollers 105 can be cylindrical bearings, which are able to withstand a large radial pressure, and can be subjected to a large polishing pressure.

The provision of the examples described herein (as well as clauses phrased as "such as," "e.g.," "including," and the like) should not be interpreted as limiting the claimed subject matter to the specific examples; rather, the examples are intended to illustrate only some of many possible aspects.

Although the disclosed subject matter has been described and illustrated in the foregoing illustrative embodiments, it is understood that one disclosure has been made only by way of example, and that numerous changes in the details of embodiment of the disclosed subject matter can be made without departing from the spirit and scope of the disclosed subject matter, which is only limited by the claims which follow. Features of the disclosed embodiments can be combined and rearranged in various ways. Without departing from the spirit and scope of the disclosed subject matter, modifications, equivalents, or improvements to the disclosed subject matter are understandable to those skilled in the art and are intended to be encompassed within the scope of one disclosure.

What is claimed is:

1. A chemical mechanical polishing apparatus, comprising:

a polishing zone, including a wafer entrance and a wafer exit;

a first wafer platform including a wafer loading region, wherein the first wafer platform is able to move from the wafer entrance to the wafer exit along a first direction;

a polishing module located in the polishing zone, including a polishing belt extended along a second direction that is perpendicular to the first direction, wherein the polishing belt is able to move along the second direction;

a slurry injection module configured for injecting slurry towards a wafer to-be-polished by the polishing module;

a polishing cleaning module located on one side of the polishing module along the first direction, wherein the polishing cleaning module is used for cleaning the wafer; and a film-thickness measuring module located on another side of the polishing module along the first direction, wherein the film-thickness measuring module is used for measuring the thickness of the wafer, wherein the polishing module, the slurry injection module, the polishing cleaning module, and the film-thickness measuring module work simultaneously on the wafer to-be-polished while the first wafer platform moves the wafer to-be-polished.

2. The chemical mechanical polishing apparatus of claim 1, wherein the polishing module further comprises:

a plurality of pulleys for driving the polishing belt to rotate.

3. The chemical mechanical polishing apparatus of claim 1, wherein slurry injection module comprises:

a plurality of slurry injection tubes;

a plurality of slurry discharge tubes; and a plurality of connector devices, wherein each connector device includes an input tube interconnected with one slurry injection tube, and at least two output tubes interconnected with one slurry discharge tube respectively.

4. The chemical mechanical polishing apparatus of claim 1, further comprising:

a pressure plate configured for applying a pressure on the polishing belt;

a pressure supplier configured for adjusting the pressure; and a pressure sensor for detecting the pressure.

5. The chemical mechanical polishing apparatus of claim 1, wherein the polishing cleaning module comprises:

a washing module, including a plurality of cleaning fluid pipes, configured for spraying a cleaning fluid to wash the wafer; and a drying module, including a plurality of air pipes, configured for drying the wafer, wherein the washing module and the drying module are arranged opposite with each other along the first direction.

6. The chemical mechanical polishing apparatus of claim 5, wherein the wafer platform comprises a guide groove surrounding the wafer loading region for collecting the cleaning fluid and the slurry flowed from the wafer loading region.

7. The chemical mechanical polishing apparatus of claim 1, further comprising:

a first linear guide arranged along the first direction, wherein the first wafer platform is connected with the first linear guide, and is able to move linearly along the first linear guide.

8. The chemical mechanical polishing apparatus of claim 7, further comprising:

a second linear guide arranged along the first direction; and a second wafer platform connected with the second linear guide, wherein the second wafer platform is able to move linearly along the first linear guide.

9. A chemical mechanical polishing apparatus, comprising:

a polishing zone, including a wafer entrance and a wafer exit a first wafer platform including a wafer loading region, wherein the first wafer platform is able to move from the wafer entrance to the wafer exit along a first direction;

a polishing module located in the polishing zone, including a polishing belt extended along a second direction that is perpendicular to the first direction, wherein the polishing belt is able to move along the second direction;

a slurry injection module configured for injecting slurry towards a wafer to-be-polished by the polishing module;

a polishing cleaning module located on one side of the polishing module along the first direction, wherein the polishing cleaning module is used for cleaning the wafer;

a film-thickness measuring module located on another side of the polishing module along the first direction, wherein the film-thickness measuring module is used for measuring the thickness of the wafer;

a first linear guide arranged along the first direction, wherein the first wafer platform is connected with the first linear guide, and is able to move along the first linear guide;

a second linear guide arranged along the first direction;

a second wafer platform connected with the second linear guide, wherein the second wafer platform is able to move along the first linear guide; and a third linear guide and a fourth linear guide arranged along the second direction, wherein the first linear guide and the second linear guide are connected with the third linear guide and the fourth linear guide, and are able to move along the third linear guide and the fourth linear guide.

10. The chemical mechanical polishing apparatus of claim 1, further comprising:

a base under the polishing module; and at least one roller under the first wafer platform, wherein the first wafer platform is able to move on the base through the at least one roller.

11. The chemical mechanical polishing apparatus of claim 1, wherein the film-thickness measuring module is an ellipsometer including a light source, a polarizer, at least one polarization analyzer, and at least one detector.

12. A chemical mechanical polishing method, comprising:

moving a first wafer from a wafer entrance to a polishing zone along a first direction;

in the polishing zone, moving the first wafer along the first direction, and simultaneously polishing the first wafer along a second direction, wherein the first direction is perpendicular to the second direction;

continuously moving the first wafer along the first direction and polishing the first wafer along the second direction, and simultaneously cleaning a polished portion of the first wafer; and continuously moving the first wafer along the first direction and polishing the first wafer along the second direction, and simultaneously measuring a cleaned portion of the first wafer.

13. The chemical mechanical polishing method of claim 12, wherein measuring the cleaned portion of the first wafer is performed by an ellipsometry.

14. The chemical mechanical polishing method of claim 13, wherein measuring the cleaned portion of the first wafer further comprises:

measuring a plurality thickness values of different cleaned portions of the first wafer to obtain a thickness distribution uniformity of the first wafer.

15. The chemical mechanical polishing method of claim 12, wherein polishing the first wafer comprises:

using a polishing belt to polish the first wafer back and forth along the second direction, wherein the polishing belt is driven by a plurality of pulleys.

16. The chemical mechanical polishing method of claim 15, wherein polishing the first wafer further comprises:

using a pressure plate to apply a pressure on the polishing belt;

using a pressure supplier to adjust the pressure; and using a pressure sensor to detect the pressure.

17. The chemical mechanical polishing method of claim 12, wherein cleaning the polished portion of the first wafer comprises:

using a washing module including a plurality of cleaning fluid pipes to spray a cleaning fluid to wash the polished portion of the first wafer; and using a drying module including a plurality of air pipes, configured to dry the first wafer, wherein the washing module and the drying module are arranged opposite with each other along the first direction.

18. The chemical mechanical polishing method of claim 12, further comprising:

placing the first wafer on a first wafer platform;

moving the first wafer platform along the first direction from the wafer entrance to a wafer exit, and simultaneously polishing the first wafer along a second direction;

moving the first wafer platform out from the polishing zone from the wafer exit along the second direction, and removing the first wafer;

moving the first wafer platform towards the wafer entrance along a direction opposite to the first direction; and repeating the above process to polish another first wafer.

19. The chemical mechanical polishing method of claim 18, further comprising:

placing a second wafer on a second wafer platform;

moving the second wafer platform along the first direction from the wafer entrance to a wafer exit, and simultaneously polishing the second wafer along the second direction, when moving the first wafer platform towards the wafer entrance along the direction opposite to the first direction;

moving the second wafer platform out from the polishing zone from the wafer exit along the second direction, and removing the second wafer;

moving the second wafer platform towards the wafer entrance along the direction opposite to the first direction, when moving the first wafer platform along the first direction from the wafer entrance to a wafer exit; and repeating the above process to polish another second wafer.

20. The chemical mechanical polishing method of claim 18, wherein the first wafer is placed on the first wafer platform by using a mechanical arm.

* * * * *